United States Patent [19]

Igel

[11] 3,950,925

[45] Apr. 20, 1976

[54] METHOD AND APPARATUS FOR AUTOMATIC RE-ATTACHMENT OF THREAD IN SPINNING MACHINES

[75] Inventor: Wolfgang Igel, Ebersbach, Germany

[73] Assignee: Zinser Textilmaschinen GmbH, Ebersbach, Germany

[22] Filed: Aug. 5, 1974

[21] Appl. No.: 494,906

[30] Foreign Application Priority Data

Aug. 4, 1973 Germany ..... 2339654

[52] U.S. Cl. ..... 57/34 R; 57/81; 57/156

[51] Int. Cl.[2] ..... D01H 13/16; D01H 13/14

[58] Field of Search ..... 57/34 R, 34.5, 81, 156, 57/22

[56] References Cited

UNITED STATES PATENTS

| | | | |
|---|---|---|---|
| 2,956,392 | 10/1960 | Ohnishi | 57/81 |
| 3,158,852 | 11/1964 | Schacher | 57/81 X |
| 3,309,859 | 3/1967 | Vehorn | 57/81 |
| 3,498,039 | 3/1970 | Kent et al. | 57/81 X |
| 3,659,409 | 5/1972 | Saunders | 57/81 X |
| 3,754,718 | 8/1973 | Abbott | 57/34.5 X |

*Primary Examiner*—Donald E. Watkins
*Attorney, Agent, or Firm*—Edwin E. Greigg

[57] ABSTRACT

In spinning machines, a thread is spun from a roving emerging from a draw frame. When a thread breakage occurs, the roving continues to emerge but its path is deviated by air currents.

The presence of the roving on the deviated path is detected and a thread re-attachment process is initiated.

An apparatus for practicing the above method includes a light source and light detector for determining the presence of the roving in the appropriate location. An alternative embodiment of the invention provides a mechanical device, e.g. a foraminous gate, to respond to the presence of unspun roving in a suction bypass channel of the spinning machine. In both cases, an actuating signal is produced for initiating the thread re-attachment process.

3 Claims, 3 Drawing Figures

METHOD AND APPARATUS FOR AUTOMATIC RE-ATTACHMENT OF THREAD IN SPINNING MACHINES

BACKGROUND OF THE INVENTION

The invention relates to a method and an apparatus for the automatic attachment of threads in spinning machines, wherein, if a sensing process determines that an attachment process is to be initiated at a particular spinning location, steps are taken for initiating the attachment process.

Known thread attachment devices include sensing mechanisms which monitor the presence of thread coming from the draw-off rollers of a spinning machine. (DT-OS No. 1932 014). When no thread is found to be present, an attachment process for the re-attachment of the thread to the roving is initiated at the particular spinning location, but no consideration is given as to why the thread may be absent or broken. If the thread breakage occurred, for example, because the roving spool has run out (is empty) or because the roving is twisted up in the draw-frame, then a thread re-attachment attempt will necessarily be unsuccessful because the precondition for the attachment of a thread, namely, the presence of a roving emerging from the draw-off rollers, is not satisfied.

OBJECT AND SUMMARY OF THE INVENTION

It is a first object of the invention to describe a method for initiating the thread re-attachment process which avoids the occurrence of these erroneous and futile attempts at re-attachment.

It is a further object of the invention to describe an apparatus for practicing the above method.

For these purposes, the invention proposes that a thread re-attachment process be initiated in the spinning machine if and only if a roving which is not being spun into a thread emerges from the two draw-off rollers of the spinning machine. If this happens, it means not only that the thread is broken and hence a re-attachment process is required, but also that a roving is actually emerging from the draw-off rollers, thus satisfying one of the essential prerequisites for the success of an attachment process.

Therefore, the method and apparatus of the invention go beyond the known attachment process which only determines, by sensing for the presence or absence of the thread, whether an attachment process is required or not. The known attachment devices do not check whether an essential prerequisite for the success of an attachment process, namely the presence of a roving at the draw-off rollers, is, in fact, satisfied. For this reason, such attachment devices often initiate attachment processes which must fail and they thus occupy the attachment mechanism needlessly. This is avoided, according to the invention because the attachment mechanism does not spend time at a spinning location where it cannot attach a thread anyway and thus it is made available for servicing a larger number of spinning locations and is made more efficient because it can re-attach more threads than could be done previously in the same time span.

In order to carry out the above process, an apparatus is provided for the automatic re-attachment of threads in spinning machines which includes at least one sensing device that can initiate the operations of an attachment mechanism. According to the invention, the sensing device senses whether a roving is being delivered by the draw-off rollers of the spinning machine but is not being spun into a thread and it initiates the operational cycle of the attachment mechanism if and only if that is the case.

A preferred embodiment of the apparatus according to the invention includes at least one light source aimed at the path of an emerging roving which is not being spun into a thread and also includes at least one light-sensitive cell aimed at the intersection of the path of the roving with the light beam from the light source. The output signal of the light sensitive cell triggers a re-attachment process. This embodiment is particularly advantageous when the re-attachment mechanism is embodied as a carriage traveling past the spinning locations. In that case, the sensing device is advantageously disposed on the attachment carriage.

In another advantageous embodiment, the roving emerging from the draw-off rollers, but not being spun into a thread, activates a sensor, located in the suction line, which releases a signal initiating the attachment process. Since a sensing device of this latter kind would be locally fixed, its application is particularly advantageous whenever the attachment mechanism is also embodied as a locally fixed attachment mechanism associated with a single spinning location.

Other sensing devices suitable for detecting the presence or absence of a roving emerging from the draw-off rollers of a draw frame could be provided.

Two preferred embodiments of apparatuses according to the invention are described below and are shown in the drawing. Further characteristics and advantages of the invention will also be explained.

DESCRIPTION OF THE PREFERRED EMBODIMENT

Figure 1:
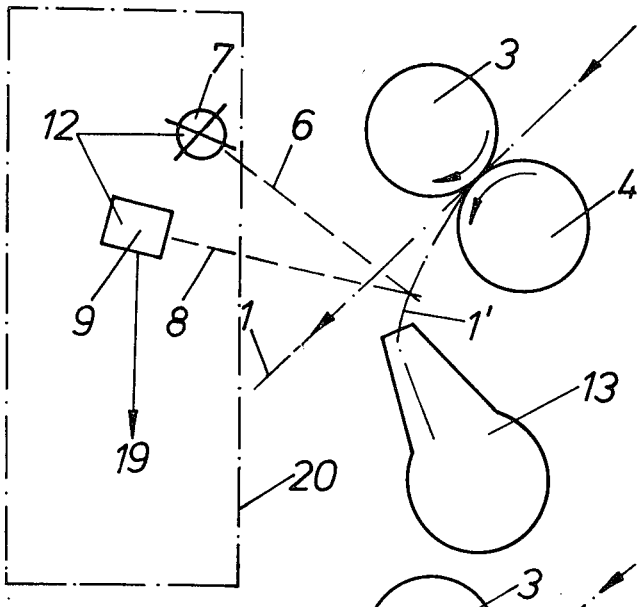
FIG. 1 of the drawing is a schematic representation of a sensing device belonging to a mechanism for the automatic re-attachment of thread in spinning machines; elements unnecessary for comprehension have been omitted.
Figure 2:
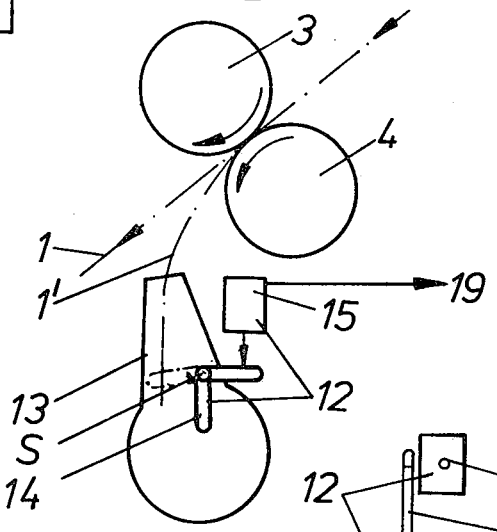
FIG. 2 is a schematic representation of another embodiment of a sensing device according to the invention.
Figure 3:
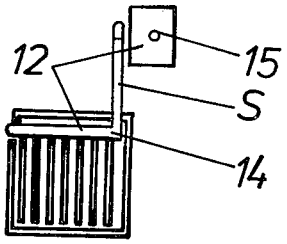
FIG. 3 is a view of the sensing device according to FIG. 2 as seen from another direction.

The two exemplary embodiments of the invention are shown in FIGS. 1 and 2, respectively, and each figure shows a pair of output or draw-off rollers 3, 4 of a customary draw-frame which is not shown in further detail and which delivers stretched roving which is normally pulled off as a twisted thread 1 and which is wound up in a known manner by means of a wind-up mechanism (not shown) consisting of a spindle, a ring and a traveler. If the thread 1 breaks, the roving 1', which continues to emerge from the draw-off rollers 3, 4, is aspirated in known manner by a suction tube 13.

In the exemplary embodiment of FIG. 1, the sensing device 12 of an automatic thread re-attachment mechanism (which may be of known construction and is therefore only symbolized by the dash-dot lines 20) includes a light source 7 and a light sensitive cell 9. According to the invention, the optical axes 6 and 8, respectively, of these elements are directed to the path of the roving 1' taken after a thread breakage. The light sensitive cell 9 delivers a signal only if the light from the light source falls on the roving 1′ and is reflected thereby into the light sensitive cell. Thus, a signal is delivered only when unspun roving travels from the draw-off rollers 3 and 4 into the suction tube 13. This happens only when the thread 1 is broken somewhere between the draw-off rollers 3, 4 and the spindle and thus is absent from the region shown but while the draw frame continues to deliver roving just as before.

In the exemplary embodiment of FIG. 2, the sensing device 12 consists of a sensor 14 in the form of a comb which is pivotable in a section of the inlet channel of the suction tube 13 associated with a spinning location. The sensor 14 is so disposed that, in the normal position, its teeth extend transversely through this section of the channel as shown by dash-dotted lines. When the sensor 14 is pivoted into the solidly drawn position, it actuates a signal generator 15.

During the normal spinning process, the roving delivered by the draw-off rollers 3 and 4 is spun into thread traveling in the direction of the arrow. In the case of thread breakage, the roving 1′, which is no longer being spun into a thread, is aspirated by the suction tube 13 and piles up at the sensor 14 disposed within the suction tube 13 which, in its normal position, is shown dotted in FIG. 2. During the further aspiration of the unspun roving 1′, the roving forms a thick layer on the sensor which then pivots about its axis S due to the force of suction. The pivoting motion of the sensor 14 actuates the signal generator 15 and results in a signal pulse. After the sensor 14 has pivoted, the layer of roving 1′ slides off, so that the suction channel is not blocked and the roving continues to be aspirated.

The signal pulses which are delivered by the light sensitive cell 9 or by the signal generator 15 through lines 19 trigger an attachment process in known manner and this process is carried out by the automatic attachment mechanism which may also be of known construction and is not further shown here.

If the sensing device 12 according to FIG. 1 is disposed on an attachment carriage 20 which travels along the spinning locations, then a signal pulse can be utilized immediately for triggering an attachment process.

In the sensing mechanism 12 according to FIG. 2, however, the signal must be stored until such time as an attachment mechanism, embodied as an attachment carriage, arrives at the location of the thread breakage and a trigger signal can then be delivered to the attachment mechanism. For example, the sensor may set a marker flag, belonging to the appropriate spinning location, whose indication is later sensed by the attachment carriage as it travels along the spinning locations. Such an installation is shown, for example, in the French Patent No. 1,510,010, in FIGS. 28 and 29.

If the attachment mechanism is embodied, in known manner, as a locally fixed mechanism associated with each and every spinning location, then the signal pulse of the similarly locally fixed signal generator 15 can also be utilized immediately. In the embodiment of the sensing device 12 according to FIG. 1, the light source 7 and the light sensitive cell 9 may then be preferably disposed in a different manner from that shown in FIG. 1, namely advantageously opposite to that side of the roving 1′ nearest the draw-off roller 4, and between that roller 4 and the suction tube 13. Such a sensing device can be disposed locally fixed at each spinning location. In that case, the signal pulses produced by the light sensitive cell 9 can also be utilized immediately for triggering a re-attachment process.

What is claimed is:

1. A method for automatically re-attaching threads to rovings in spinning machines, comprising the steps of:

a. applying suction to the roving for deviating it from its first normal position to a second position when a thread breakage has occurred;

b. photoelectrically detecting the presence of the roving in said second position and providing a signal; and c. initiating a thread re-attachment sequence upon detection of said signal.

2. Apparatus for the automatic re-attachment of threads to the roving in spinning machines having a draw frame and draw-off rollers, said apparatus comprising:

a. suction means, disposed adjacent to the normal position of the roving and capable of exerting a lateral suction force on the roving for deviating the roving from a first, normal position to a second position;

b. an electric light source, for illuminating the roving in said second position;

c. photoelectric sensor means, capable of providing a signal when light is reflected from the roving in said second position; and d. thread re-attachment means, responsive to said signal for re-attaching thread if roving is present in said second position.

3. An apparatus for the automatic re-attachment of threads to the roving in spinning machines having a draw frame and draw-off rollers, said apparatus comprising:

a. suction means, disposed adjacent to the normal position of the roving and capable of exerting a lateral suction force on the roving for deviating the roving from a first, normal position to a second position;

b. sensor means, located within said suction means and capable of providing a signal;

c. signal storage means, actuated by said signal and capable of initiating a thread re-attachment process arbitrarily later than the time of occurrence of said signal.

* * * * *